US007580507B2

(12) United States Patent
Lu et al.

(10) Patent No.: US 7,580,507 B2
(45) Date of Patent: Aug. 25, 2009

(54) LIQUID FLOW SENSOR FOX X-RAY TUBES

(75) Inventors: Qing Kelvin Lu, Aurora, IL (US); Kevin Charles Kraft, Bolingbrook, IL (US); Fince Tendian, Aurora, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/596,964

(22) PCT Filed: Jan. 5, 2005

(86) PCT No.: PCT/IB2005/050046

§ 371 (c)(1),
(2), (4) Date: Oct. 3, 2007

(87) PCT Pub. No.: WO2005/069342

PCT Pub. Date: Jul. 28, 2005

(65) Prior Publication Data

US 2008/0069293 A1 Mar. 20, 2008

Related U.S. Application Data

(60) Provisional application No. 60/536,074, filed on Jan. 13, 2004.

(51) Int. Cl.
*H01J 35/10* (2006.01)

(52) U.S. Cl. ..... 378/141; 378/200

(58) Field of Classification Search ..... 378/130, 378/141, 119, 117, 4–20, 199–200; 417/18
See application file for complete search history.

(56) References Cited

U.S. PATENT DOCUMENTS

| | | | | |
|---|---|---|---|---|
| 5,732,123 | A | 3/1998 | Peralta et al. | |
| 6,286,998 | B1 * | 9/2001 | Dilick | 378/200 |
| 6,623,160 | B2 | 9/2003 | McCarthy, Jr. | |
| 2002/0146092 | A1 * | 10/2002 | Richardson et al. | 378/130 |
| 2004/0011305 | A1 * | 1/2004 | Herynek et al. | 123/41.02 |
| 2005/0159735 | A1 * | 7/2005 | Walton et al. | 606/21 |

* cited by examiner

*Primary Examiner*—Hoon Song

(57) ABSTRACT

A housing (30) surrounds at least a portion of an x-ray tube (1). A cooling system (32, 32') supplies a cooling liquid through the housing. The cooling system includes a pump (40, 40') and a flow sensor system (60, 60') which measures a pressure difference across the pump. A processor (80, 80', 82, 82') determines a cooling fluid flow rate from the pressure difference. A controller (81, 81', 82, 82', 107) limits operation of the x-ray tube based on the cooling fluid flow rate and a measured temperature of the cooling fluid to prevent x-ray tube overheating while minimizing cooling time between x-ray tube operations.

22 Claims, 6 Drawing Sheets

LIQUID FLOW SENSOR FOX X-RAY TUBES

CROSS REFERENCE TO RELATED CASES

Applicants claim the benefit of Provisional Application Ser. No. 60/536,074, filed Jan. 13, 2004.

The present application relates to the x-ray tube arts. The invention finds particular application in monitoring the flow of a cooling liquid to an x-ray tube and will be described with particular reference thereto. It will be appreciated, however, that the invention finds application in a variety of fluid systems where it is desirable to monitor fluid flow or thermal characteristics.

x-ray tubes typically include an evacuated envelope made of metal, ceramic, or glass which is supported within an x-ray tube housing. The envelope houses a cathode assembly and an anode assembly. The cathode assembly includes a cathode filament through which a heating current is passed. This current heats the filament sufficiently that a cloud of electrons is emitted, i.e. thermionic emission occurs. A high potential, on the order of 100-200 kV, is applied between the cathode assembly and the anode assembly. The electron beam strikes the target with sufficient energy that x-rays are generated, along with large amounts of heat.

An x-ray tube housing surrounding the tube defines a flow path for a coolant fluid, such as oil, to aid in cooling components housed within the envelope. In order to distribute the thermal loading created during the production of x-rays, a constant flow of cooling liquid is maintained throughout x-ray generation. After circulating through the x-ray tube housing, the cooling liquid is passed through a heat exchanger. The optimum flow rate of cooling liquid depends on a number of factors, including the x-ray tube power, its duty cycle, and the effectiveness of the cooling system. In the event that the liquid flow rate drops below a minimum level, for example, due to pump malfunction, overheating of the x-ray tube components tends to occur, which is detrimental to the lifetime of the tube.

Various systems have been developed to monitor liquid flow in an x-ray tube cooling system. In one system, a flow switch is positioned in the path of the fluid flow. As the liquid flows through the switch, the liquid displaces a magnet, which in turn actuates a hermetically sealed reed switch. A positive spring return deactivates the switch when the flow decreases. A flow indicator, such as a paddle wheel, is often used together with the flow switch to provide a visual flow indicator. The liquid passing the flow indicator spins the wheel, visually indicating flow speed.

Because both the flow switch and flow indicator are installed in line with the liquid flow, their presence inevitably creates flow resistance which reduces the liquid flow rate. This reduces the cooling capacity of the cooling system.

In an alternative system, a pressure switch is used to monitor the liquid flow indirectly. The pressure switch is usually installed at the outlet of the pump used to circulate the cooling fluid. If the detected pressure decreases below a preselected level, the pressure switch automatically shuts down the x-ray tube. A sharp drop in pump pressure is often an indicator that the pump is losing power or failing.

In the case of the pressure switch, however, pump outlet pressure does not always accurately predict flow rates. For example where flow lines of the cooling system become partially obstructed or twisted, the pump pressure tends to increase as the pump works harder to maintain flow through the obstruction. As the pump starts to fail, the pressure "drops" to normal, but the flow, due to the obstruction, is below normal. Thus, the pressure switch does not always protect the x-ray tube from overheating due to the loss in liquid flow.

The temperature of the cooling fluid within the x-ray tube housing depends not only on the flow rate, but also on other factors, such as the duty cycle power. An algorithm computes the maximum power which can be used in a subsequent scanning operation, based on the duty cycle, the tube heat storage, and a predicted temperature in the cooling liquid. Over time, the accuracy of the algorithm computations decreases due to increasing differences between the actual and the predicted temperatures and cooling rates. To compensate for these inaccuracies, the x-ray tube is often removed from service for an extended period during the day, such as an hour or more at mid day, to allow the x-ray tube to cool to a know set point.

The present invention provides a new and improved method and apparatus which overcome the above-referenced problems and others.

In accordance with one aspect of the present invention, an assembly is proved. The assembly includes an x-ray tube. The x-ray tube includes an envelope which defines an evacuated chamber in which x-rays are generated. A housing surrounds at least a portion of the envelope. A cooling system circulates a cooling liquid through the housing to remove heat from the x-ray tube. The cooling system includes a pump and a flow sensor system which is responsive to a pressure difference across the pump.

In accordance with another aspect of the invention, a method for controlling operation of an x-ray tube is provided. The method includes circulating a cooling fluid through a housing and over the x-ray tube with a pump. Heat is removed from the cooling fluid which has circulated through the housing. A flow rate of the cooling fluid is determined. This step includes determining a pressure difference across the pump or a function which correlates with the pressure difference and determining the flow rate from the pressure difference or function.

In accordance with another aspect of the invention, a system for removing heat from an associated x-ray tube assembly is provided. The system includes a fluid flow path which carries a cooling fluid to at least a portion of the associated x-ray tube, and removes heat therefrom. A pump circulates the cooling fluid through the fluid flow path. Means are provided for determining a pressure difference across the pump. Means responsive to the determined pressure difference are provided for controlling operation of the x-ray tube.

One advantage of at least one embodiment of the present invention is that it enables flow rates in an x-ray tube cooling system to be determined.

Another advantage of at least one embodiment of the present invention is that it enables flow rates to be determined without reducing the liquid flow.

Another advantage of at least one embodiment of the present invention is that x-ray tube down time is reduced due to a more accurate prediction of x-ray tube power capabilities.

Another advantage resides in extending x-ray tube life.

Still further advantages of the present invention will become apparent to those of ordinary skill in the art upon reading and understanding the following detailed description of the preferred embodiments.

The invention may take form in various components and arrangements of components, and in various steps and arrangements of steps. The drawings are only for purposes of illustrating a preferred embodiment and are not to be construed as limiting the invention.

Figure 1:
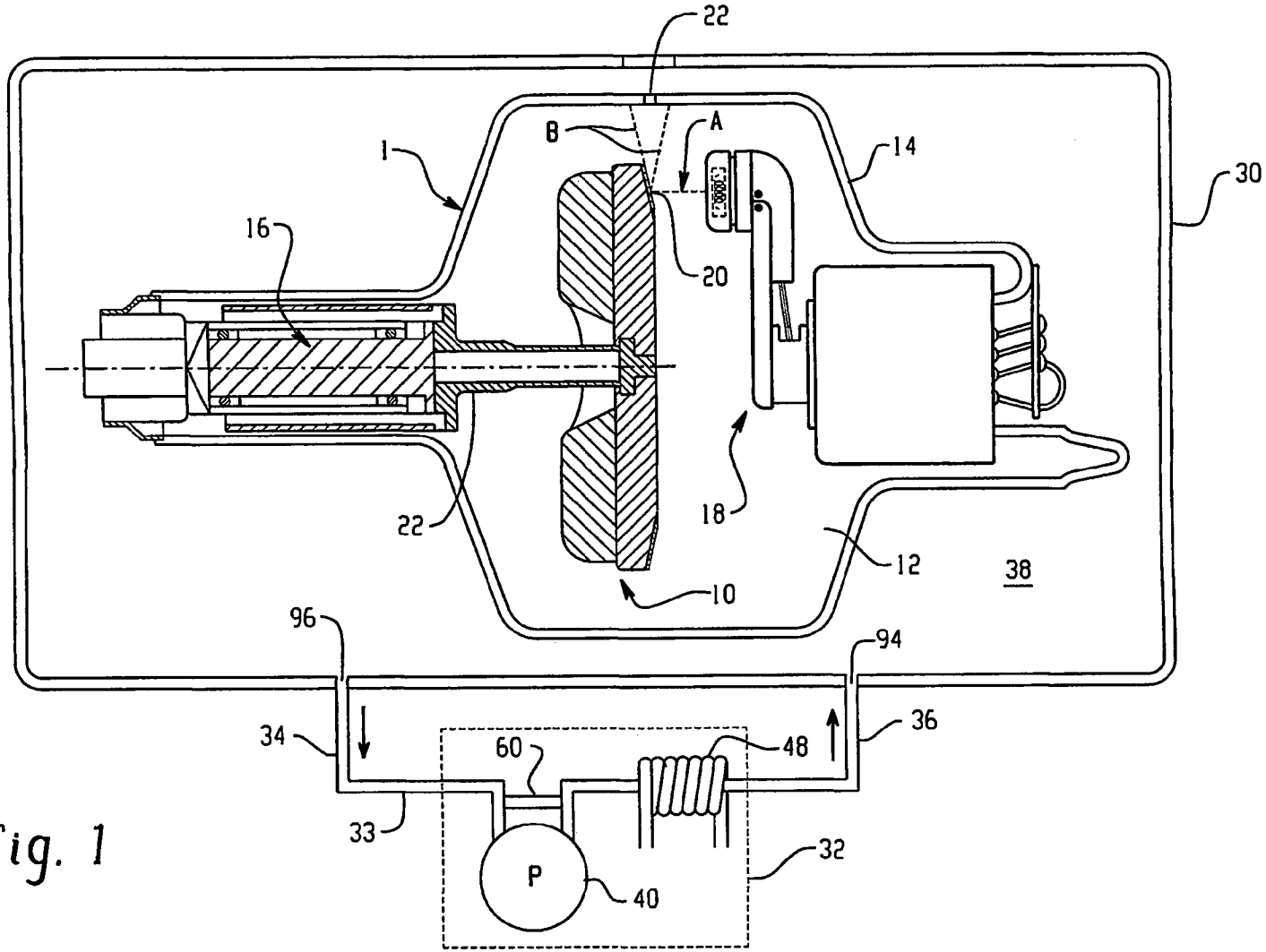
FIG. 1 is a diagrammatic illustration of an x-ray tube and cooling system according to a first embodiment of the present invention.

With reference to FIG. 1, a schematic view of a rotating anode x-ray tube 1 of the type used in medical diagnostic systems, such as computed tomography (CT) scanners, for providing a beam of x-ray radiation is shown. The tube includes an anode assembly 10, which is rotatably mounted in an evacuated chamber 12, defined by an envelope or frame 14, typically formed from glass, ceramic, or metal. The x-ray tube anode assembly 10 is mounted for rotation about an axis via a bearing assembly shown generally at 16. A heated element cathode assembly 18 supplies and focuses an electron beam A. The cathode is biased, relative to the anode, such that the electron beam is accelerated to the anode and strikes a target area 20 of the anode. The beam striking the target area is converted in part to heat and in part to x-rays B, which are emitted from the x-ray tube through a window 22 in the envelope. The anode is rotated at high speed during operation of the tube. It is to be appreciated that the invention is also applicable to stationary anode x-ray tubes, rotating cathode tubes, and other electrode vacuum tubes.

A housing 30 filled with a heat transfer and electrically insulating cooling fluid, such as a dielectric oil, surrounds the envelope 14. The cooling fluid is directed to flow past the insert that includes the window 22, the bearing assembly 16, cathode assembly 18, and other heat-dissipating components of the x-ray tube. The cooling fluid is cooled by a cooling system 32, which receives heated cooling liquid from the housing through an outlet line 34 and returns cooled cooling liquid via a return line 36. The lines 34, 36 may be in the form of flexible hoses, metal tubes, or the like.

In the illustrated embodiment, the housing 30 is shown as a unitary structure defining an interior cooling space 38 which cools the entire x-ray tube 1. However, it will be appreciated that the housing may include different regions, which are associated with different portions of the x-ray tube, to allow separate or focused cooling of components which are more prone to overheating. Indeed, the housing may constitute multiple cooling housings, which may be interconnected by fluid lines, or separately connected with the cooling system. Additionally, it is also contemplated that there may be more than one outlet and/or return line to the housing.

Figure 2:
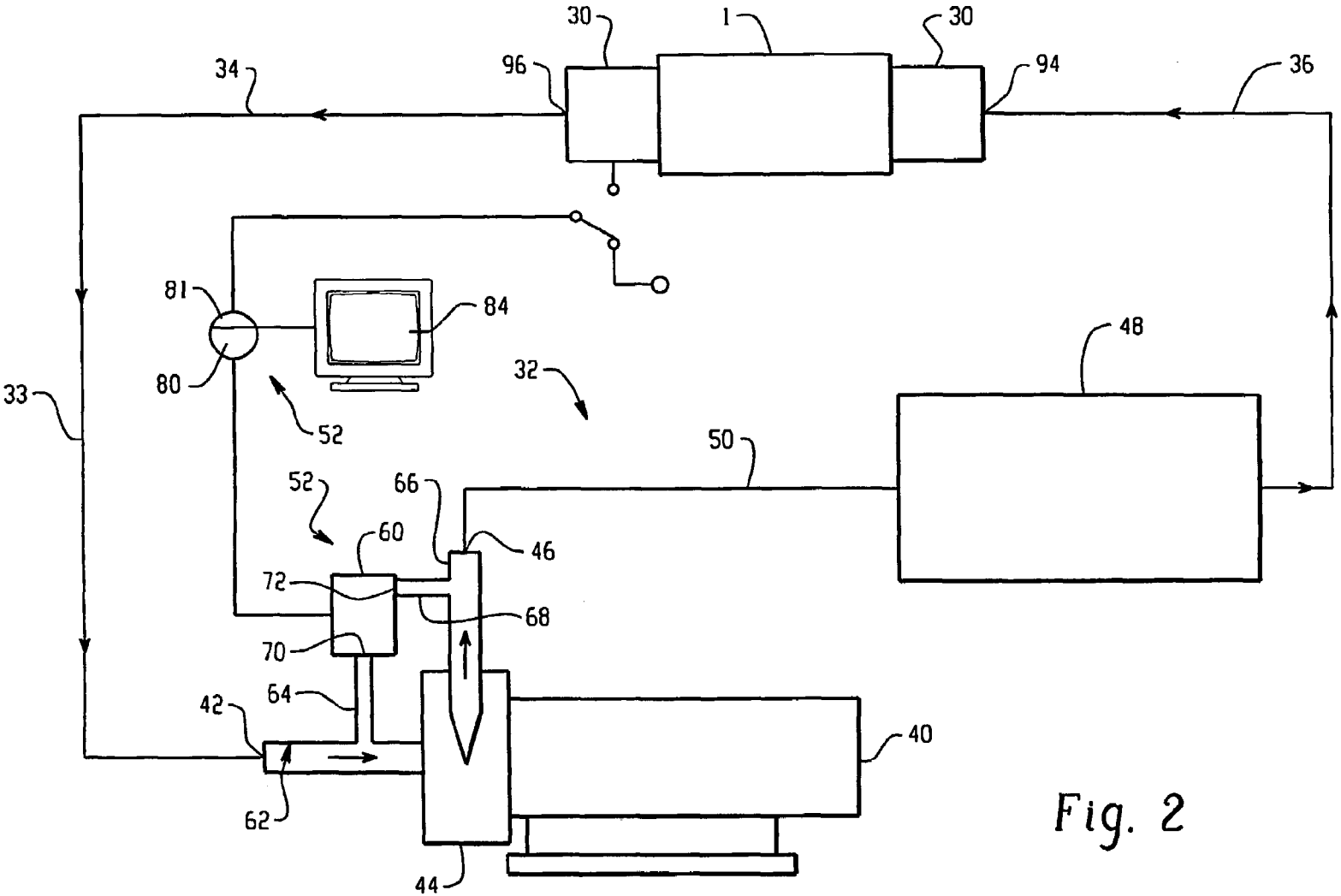
FIG. 2 is a more detailed diagram of the x-ray tube and cooling system of FIG. 1.

With reference now to FIG. 2, the cooling system 32 includes a liquid pump 40, having an inlet 42, through which cooling fluid enters a chamber 44 of the pump, and an outlet 46, through which cooling fluid leaves the pump chamber 44. A heat exchanger 48 removes heat from the cooling liquid prior to return of cooling liquid to the housing. In the illustrated cooling system 32, heated liquid flows along a fluid flow path 33 via the outlet line 34 to the liquid pump, then by an intermediate fluid line 50 from the pump 40 to the heat exchanger 48, and finally returning to the housing via the return line 36. Within the housing 30, the cooled cooling liquid circulates around the x-ray tube 1, or components thereof, removing heat before exiting from the outlet line 34. However, it will be appreciated that the positions of the pump and the heat exchanger may be reversed such that the cooling liquid from the housing is cooled prior to reaching the pump.

A system 52 for detecting a pressure difference across the pump 40 includes a non-obstructing flow sensor system 60, such as a differential pressure transducer. The transducer 60 is responsive the pressure difference across the pump and provides an electrical signal corresponding thereto. Specifically, the pressure transducer 60 is connected with a wall 62 of the inlet 42 by a first fluid line 64 and with a wall 66 of the pump outlet 46 by a second fluid line 68. The fluid lines 64 and 68 terminate at first and second diaphragms 70, 72 of the transducer, which respond to changes in the pressure in lines 64 and 66 by exhibiting volumetric changes. The changes in the diaphragms are detected by one or more volumetric detection sensors (not shown) within the pressure transducer 60 and converted to electrical voltages.

The transducer 60 does not obstruct the flow of liquid in the cooling system flow path 33, since no liquid flows through the transducer. This avoids reduction in the flow of liquid caused by the flow measuring equipment. Additionally, in the event of a blockage or kink in one of the cooling lines 34, 36, 50, which comprise the flow path 33, the reduced flow downstream of the pump 40 is recognized as an increase in pressure by the downstream diaphragm 72 with no increase or a decrease on upstream diaphragm 70 and the transducer responds accordingly.

Figure 3:
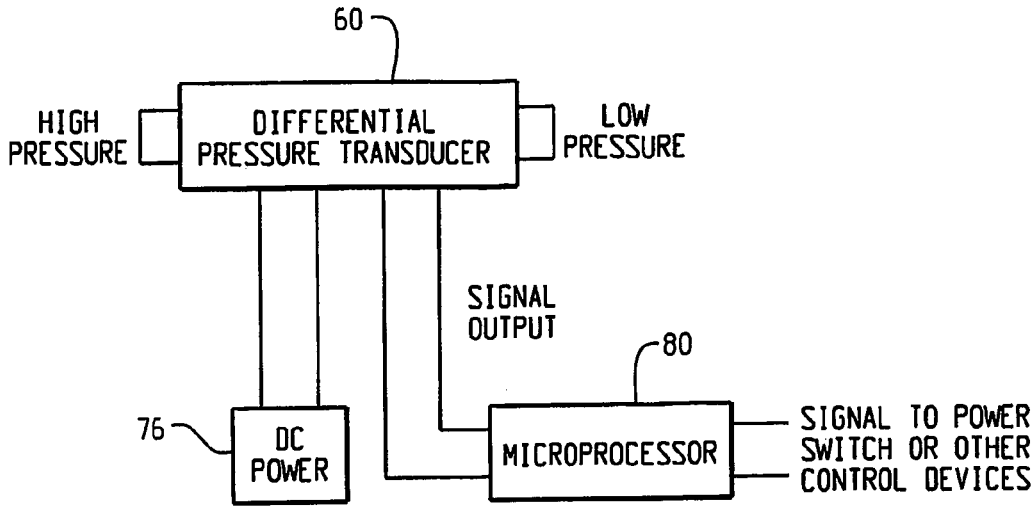
FIG. 3 is a schematic view of the pressure sensing system of FIG. 2.

With reference now to FIG. 3, power for the transducer 60 is supplied by a power source 76, such as a DC power supply. The DC power supply is optionally tapped from the main power source of the x-ray tube and rectified. Alternatively, a separate power source, such as a set of batteries is employed. The use of batteries tends to reduce the risk of interference of electrical signals from the electrical system of the x-ray tube and thus helps to increase the accuracy of the flow measurements.

With continued reference to FIG. 3, the detection system 52 further includes a processing means 80, such as a microprocessor. The microprocessor 80 receives a signal output from the differential pressure transducer. In one embodiment, the transducer 60, in response to a pressure difference between the inlet 42 and the outlet 46, signals an output voltage to the microprocessor 80. In an alternative embodiment, the transducer 60 signals first and second voltages corresponding to the input and output sensed volumetric changes. The microprocessor 80 then determines the differential voltage. In both embodiments, the microprocessor 80 converts the signal(s) from the transducer 60 to flow rate measurements, or a correlated function, in real time.

While a transducer 60 is a preferred non-obstructing flow sensor system it is also contemplated that the system 60 may alternatively include first and second independent flow sensors (not shown), upstream and downstream of the pump, respectively. Each of the flow sensors optionally includes a diaphragm similar to diaphragms 70, 72 and an associated volumetric sensor for detecting volumetric, pressure, fluxation, or other pressure indicating changes to the diaphragm. The two flow sensors independently send signals to the processor 80, which uses the signals to determine the differential pressure and or flow rate.

Figure 4:
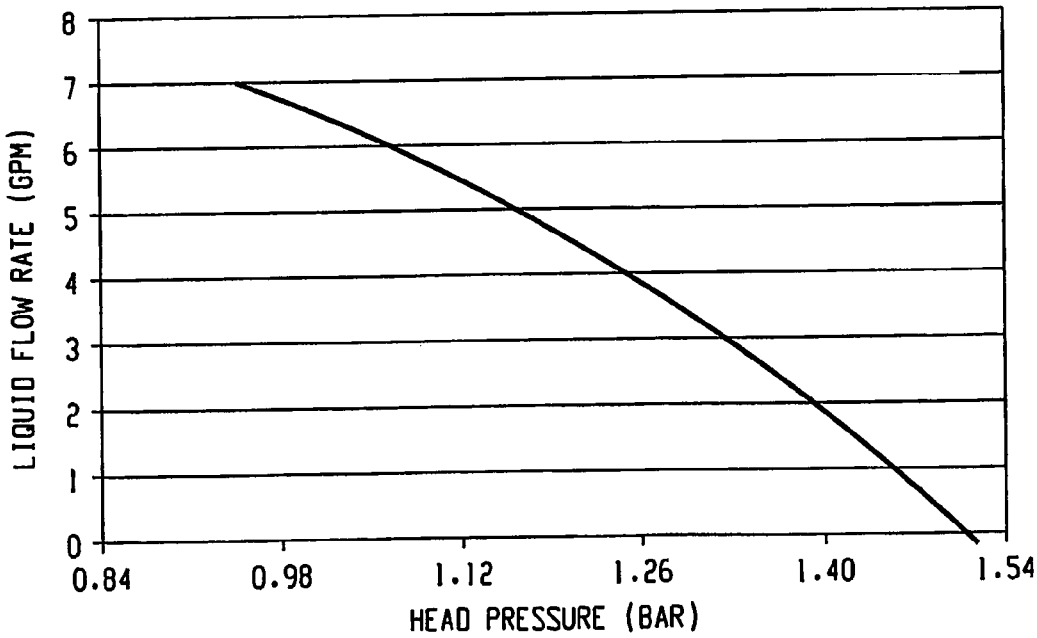
FIG. 4 is an exemplary plot of liquid flow rate in gallon/minute (GPM) vs. the differential pressure across a pump in Bar.
Figure 5:
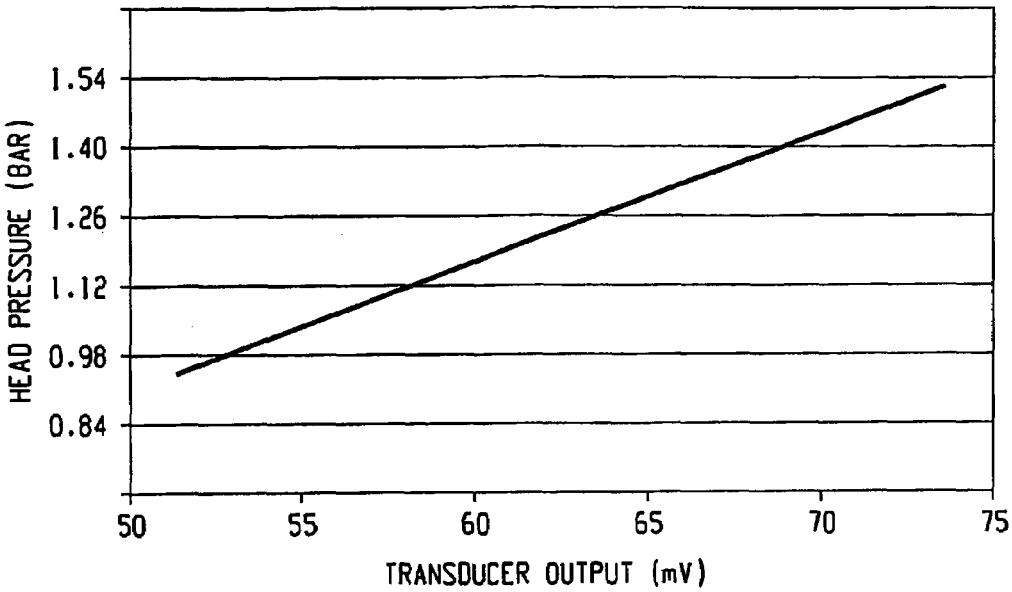
FIG. 5 is an exemplary plot of the differential pressure across a pump (Bar) vs. transducer output in millivolts (mV)
Figure 6:
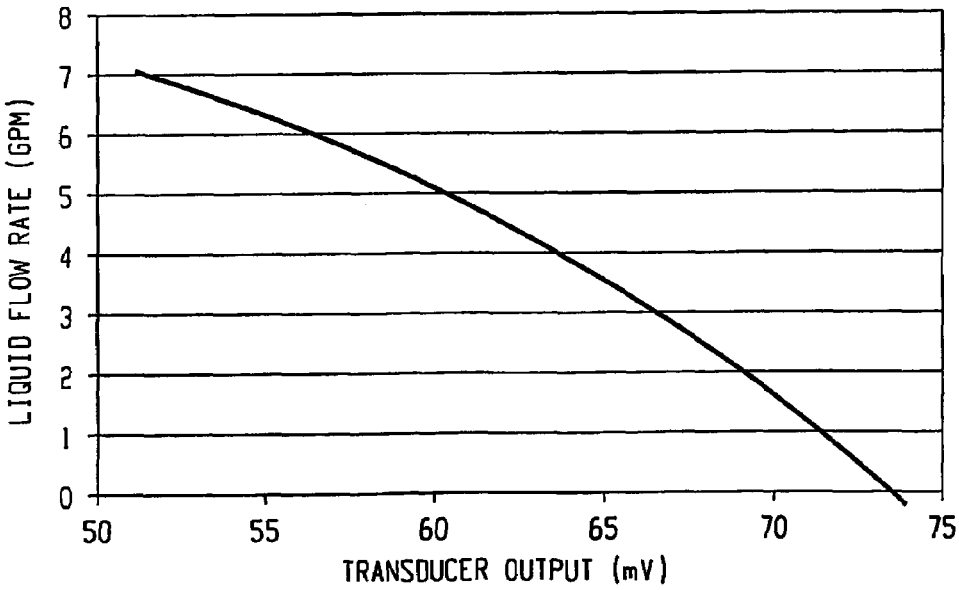
FIG. 6 is an exemplary plot of liquid flow rate (GPM) vs. transducer output obtained from the plots of FIGS. 4 and 5.

There is a relationship between the liquid flow rate in the cooling system 32 and the pressure difference across the pump 40 (head pressure), which is determined experimentally and then used to create a correlation. A typical plot of liquid flow rate in gallons per minute (GPM) vs. the pressure difference across a pump 40 is illustrated in FIG. 4 (1 gallon=3.785 liters). There is also a relationship between the transducer output voltage and the head pressure. A typical plot of head pressure vs. the transducer output is illustrated in FIG. 5. The illustrated plot was obtained using an OMEGA PX26 differential pressure transducer which uses a 10VDC power and produces a voltage signal that is proportional to the differential pressure. By combining these two plots (FIGS. 4 and 5), a correlation between liquid flow rate as a function of transducer output is obtained, as illustrated in FIG. 6. Thus, the pressure difference detected by the transducer 60 can be used to monitor the flow rate through the cooling system and hence through the housing 30.

With reference once more to FIG. 2, the microprocessor 80 is programmed to initiate a response if the detected flow rate (or electrical signals corresponding thereto) falls below a predetermined safe level. For example, the microprocessor 80 also serves as a control means 81 which signals a power switch 82, when the flow rate falls below the predetermined safe level. The power switch 82 responds by immediately shutting down power to the cathode 18 (or at least reducing the power to the cathode).

Alternatively or additionally, the processing means 80 employs an algorithm or pre-programmed look-up table to determine the energy that the x-ray tube can sustain, without risking overheating, e.g., the maximum operating time at a selected power level. In one embodiment, in the event that the determined flow rate suggests that the x-ray tube is likely to overheat if it is used without allowing a sufficient cool down time, the control means 81 of microprocessor 80 provides a prompt to a user of the x-ray tube, e.g., via a video display screen 84, to indicate that a cool down time should be allowed before the x-ray tube is used for further generation of x-rays. The processor 80 calculates a suitable cool down time and optionally overrides attempts to operate the x-ray tube until the time period is over or the x-ray tube has cooled to a maximum allowable starting temperature.

In one embodiment, the processing means 80 is the microprocessor associated with a control system for a radiographic device in which the x-ray tube is operated, such as a CT scanner.

While the transducer 60 is illustrated as being outside the pump 40, it is also contemplated that the transducer and optionally also the processing means 80 may be integral with the pump.

Figure 7:
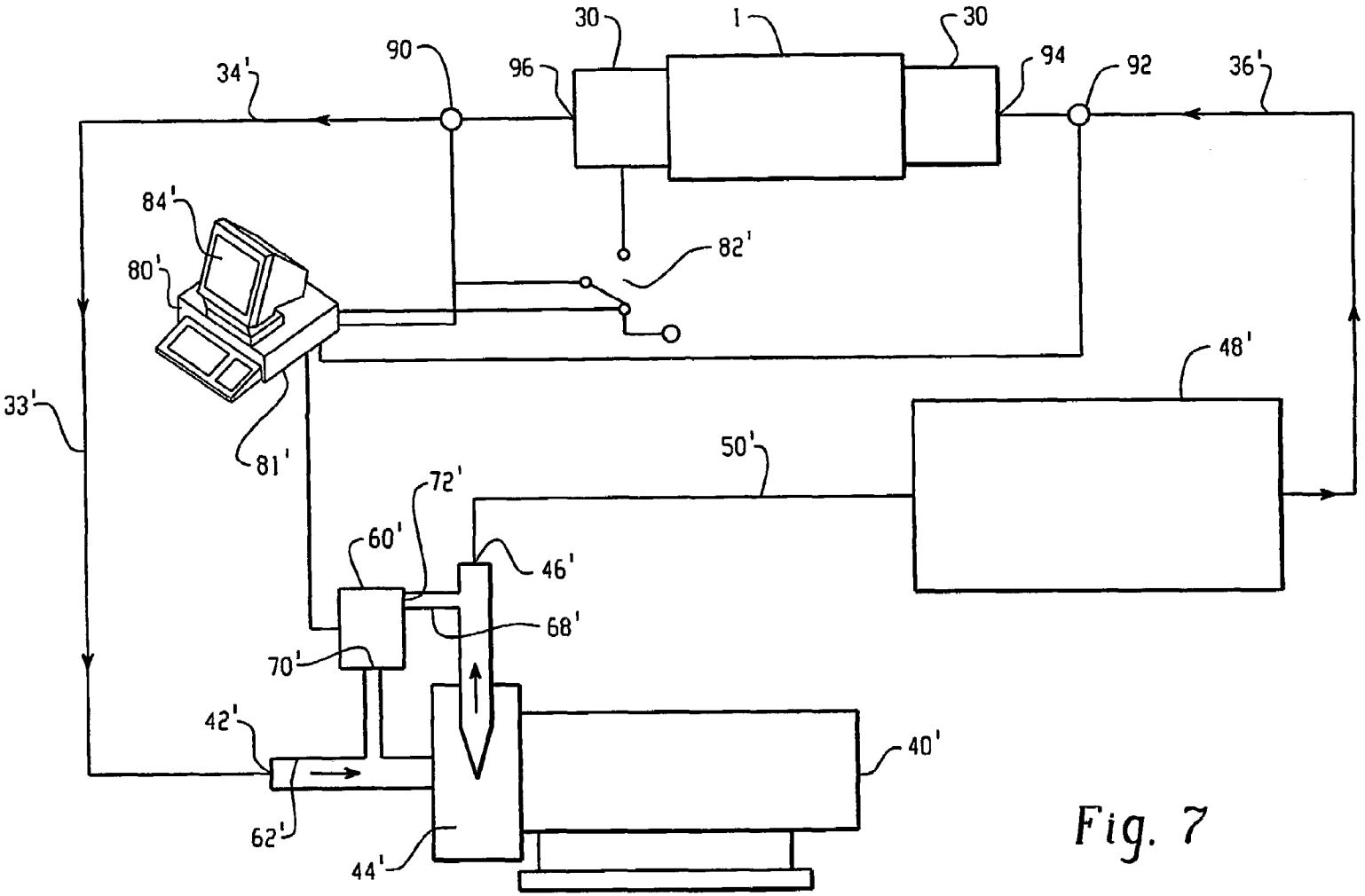
FIG. 7 is a diagrammatic view of an x-ray tube and cooling system according to a second embodiment of the present invention.

With reference now to FIG. 7, an alternative embodiment of a cooling system for an x-ray tube is shown. Similar elements of the cooling system are identified by a primed suffix (') and new elements are given new numbers. One or more temperature sensors, such as resistance thermometers, or the like, detect the temperature of the cooling liquid. In the illustrated embodiment, two temperature sensors 90, 92 measure the temperature of the cooling liquid at or adjacent inlet and outlet 94, 96, respectively, of the housing 30. For example, the sensors 90, 92 may be positioned in the outlet and return lines 34', 36', respectively. It is also contemplated that the sensor or sensors 90, 92 could additionally or alternatively be positioned in contact with the cooling fluid within the housing 30.

The temperature sensors 90, 92 are connected with a processing means, such as a processor 80'. The sensors respond to temperature changes in the cooling liquid and send detected temperatures or signals representative thereof to the processor 80'. The processor also receives signals from the transducer 60' in real time. The processor 80' includes algorithms, precalculated look-up tables, or other means for converting the signals from the temperature sensors and transducer into real time cooling fluid temperatures and cooling liquid flow rates. The processor also includes a thermal algorithm or other means for computing a parameter of the x-ray tube, such as the x-ray tube heat storage in real time and/or maximum energy (power-time) at which the x-ray tube can operate without risking overheating, based on the computed flow and temperatures and duty cycle power and time. This information is used to control a device, such as a CT scanner, which makes use of the x-ray tube 1.

It will be appreciated that in place of receiving inputs from temperature sensors, the processor 80 can use a conventional algorithm or other means to predict the cooling fluid temperature.

Figure 8:
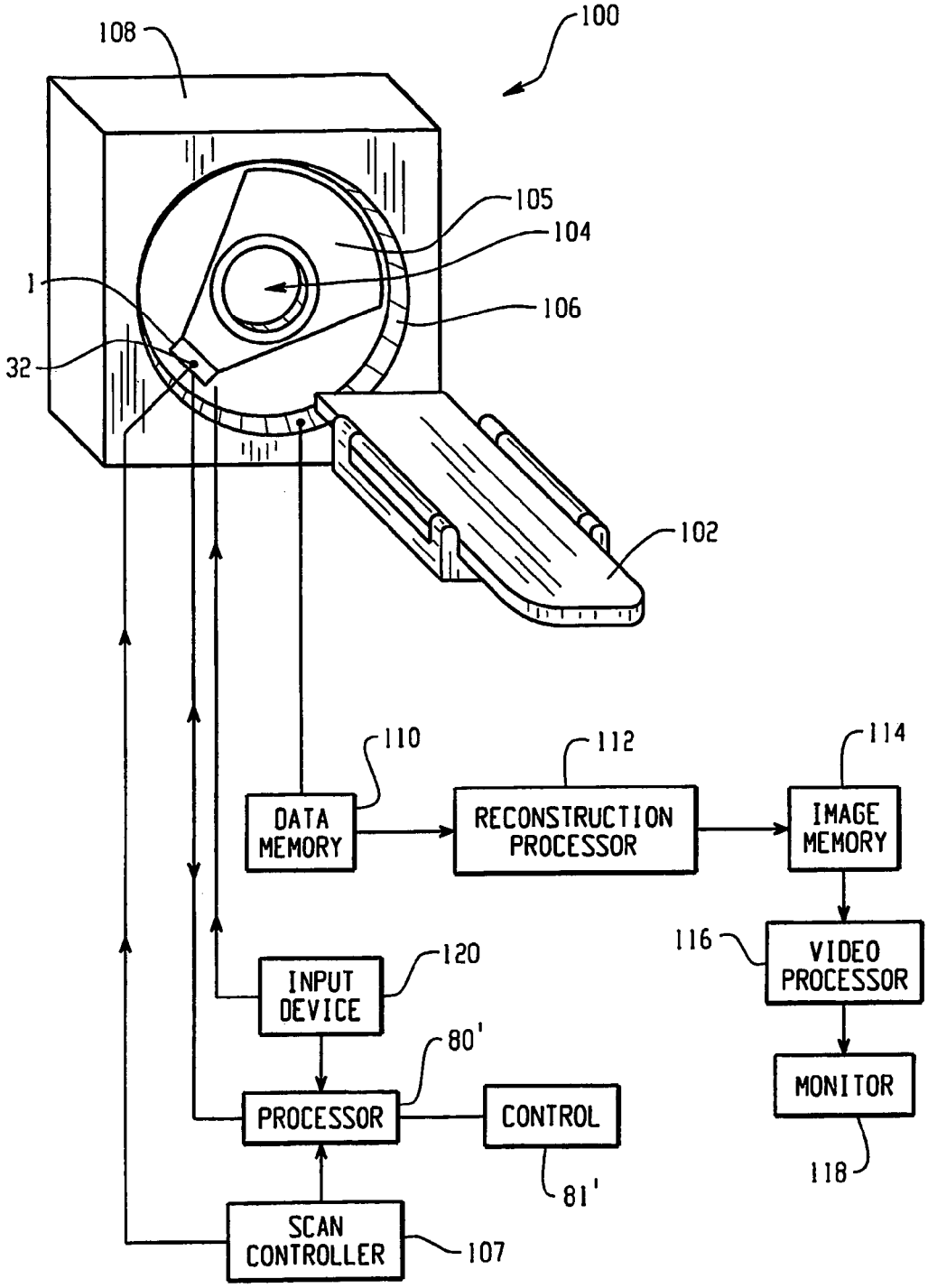
FIG. 8 is a perspective view of a CT scanner incorporating an x-ray tube and cooling system according to the present invention.

An exemplary CT scanner 100 is illustrated in FIG. 8. The CT scanner radiographically examines and generates diagnostic images of a subject disposed on a patient support 102. More specifically, a volume of interest of the subject on the patient support 102 is moved into an examination region 104. An x-ray tube assembly 1 with an associated cooling system 32' is mounted on a rotating gantry 105 and projects one or more beams of radiation through the examination region 104 to an x-ray detector 106.

A scan controller 107 controls the scanner 100 including the x-ray tube 1 to perform a selected scan protocol, such as a single revolution multislice scan, a helical scan, a multiple revolution examination to monitor physiological changes or evolution, such as a cardiac scan to image selected cardiac phases, a contrast agent uptake scan, and the like, a fluoroscopic exam, a pilot scan, and the like. The scan protocols can have different durations, different x-ray tube duty cycles, and different tube operating powers.

The electrical signals from the detectors 106, along with information on the angular position of the rotating gantry, are digitized by analog-to-digital converters. The digital diagnostic data is communicated to a data memory 110. The data from the data memory 110 is reconstructed by a reconstruction processor 112. Volumetric image representations generated by the reconstruction processor are stored in a volumetric image memory 114. A video processor 116, which may be the same as processor 80', withdraws selective portions of the image memory to create slice images, projection images, surface renderings, and the like, and reformats them for display on a monitor 118 such as a video or LCD monitor.

During a scanning procedure, the processor 80' receives temperature and pressure differential information from the temperature sensors 90, 92 and pressure transducer 60'. The processor may also receive inputs such as cycle power and number of slices to be examined in the next patient examination process from a touch screen, key pad, or other input device 120.

The processor 80' employs a thermal algorithm or means to determine a cooling condition of the x-ray tube housing 30 which corresponds to the heat stored in the x-ray tube in real time. The processor 80' uses the cooling condition and the next scan parameters to predict whether the next scanning procedure will cause the x-ray tube cooling fluid to exceed a maximum safe temperature or heat storage value and thus potentially cause damage to the x-ray tube. This allows optimization of the time between scanning procedures, steps in a scanning procedure, patient ordering, and the like. The maximum safe temperature is based on information available about the performance of the particular type of x-ray tube and includes a margin of error for ensuring safety of the x-ray tube.

A typical scanning procedure proceeds as follows:

1. The pump 40, 40' pumps cooling fluid through the x-ray tube housing 30.

2. The transducer 60, 60' continuously or intermittently monitors the pressure difference of the pump and sends signals to processor.

3. The temperature sensors 90, 92 (where present) continuously or intermittently monitor cooling fluid temperature at the inlet and outlet 94, 96 of the housing 30 and send signals to processor 80'.

4. An operator inputs selectable parameters of a scanning procedure, such as the number of slices through the processor input 120, such as a keyboard.

5. The processor 80, 80' inputs appropriate selectable parameters and signals from the temperature sensors and transducer 60, 60' to an algorithm which determines the heat storage (or temperature) of the x-ray tube cooling fluid as a function of time.

6. The processor 80, 80' and the scan controller 107 control the operation of the scanning procedure to optimize time between scans while maintaining the heat storage of the x-ray tube below a predetermined maximum level. Alternatively, the processor shuts off power to the x-ray tube until the heat storage of the x-ray tube drops to a preselected level to allow the scanning procedure to proceed without exceeding the predetermined maximum heat storage of the x-ray tube.

7. In the event that the processor detects that the maximum heat storage (or temperature) has been achieved, the processor 80, 80' signals the power switch 82' or scan controller 107 to switch off power immediately to the x-ray tube.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiment, the invention is now claimed to be:

1. An assembly comprising:
an x-ray tube;
a housing which surrounds at least a portion of the x-ray tube;
a cooling system which circulates a coolant through the housing to remove heat from the x-ray tube, the cooling system including a pump and a flow sensor system capable of measuring a pressure difference across the pump and determining a coolant flow rate from the measured pressure difference; and
a controller for controlling operation of the x-ray tube in response to the sensed flow rate.

2. The assembly of claim 1, wherein the flow sensor system includes a differential pressure transducer.

3. The assembly of claim 1, wherein the cooling system further includes:
a recirculating fluid flow path including a first fluid line which connects the housing with an upstream end of the pump, and a second fluid line which connects a downstream end of the pump with the housing, and wherein the measured pressure difference is a pressure difference between the first fluid line and the second fluid line.

4. The assembly of claim 1, wherein the measured pressure difference is a difference between a first pressure upstream of the pump and a second pressure downstream of the pump.

5. The assembly of claim 1, further including a processor capable of receiving a signal from the flow sensor system that is correlated with the measured pressure difference and capable of determining the flow rate from the signal.

6. The assembly of claim 1, wherein the controller controls operation of the x-ray tube in the event that the determined flow rate is below a preselected minimum level.

7. The assembly of claim 1, wherein the controller is capable of controlling at least one of:
operating power of the x-ray tube;
operating time of the x-ray tube;
selection of a scan protocol; and
the length of a cooling period of the x-ray tube.

8. The assembly of claim 1, further including:
a temperature sensor for sensing a temperature of the coolant circulating in at least one of the housing and the cooling system.

9. The assembly of claim 8, further including:
a processor capable of receiving signals from the temperature sensor and the flow sensor system and determining from the received signals an indication of thermal loading or remaining thermal capacity of the cooling system.

10. The assembly of claim 9, wherein the processor is capable of determining the length of a cooling period based on the determined indication, and based on an x-ray tube power, operating time, and duty cycle of a planned scan protocol, so as to ensure that the x-ray tube is capable of performing the planned protocol without overheating.

11. The assembly of claim 1, wherein the x-ray tube is the x-ray tube of a CT scanner.

12. A CT-scanner comprising:
the assembly of claim 1;
an x-ray detector;
a scan processor; and
a display.

13. A method for controlling operation of an x-ray tube, the method comprising:
circulating a cooling fluid coolant through a housing which surrounds at least a portion of the x-ray tube using a pump;
removing heat from the coolant which has circulated through the housing;
determining a flow rate of the coolant by measuring a pressure difference across the pump or a function which correlates with the pressure difference; and
controlling operation of the x-ray tube in response to the determined flow rate.

14. The method of claim 13, wherein the step of controlling operation of the x-ray tube comprises reducing power to the x-ray tube when the determined flow rate drops below a predetermined minimum value.

15. The method of claim 13, further including:
detecting at least one temperature of the coolant.

16. The method of claim 15, further including:
determining a temperature difference between two temperatures of said at least one temperature.

17. The method of claim 15, further including:
determining a thermal loading condition of the x-ray tube from the detected temperature and the determined flow rate.

18. The method of claim 17, further including:
in response to the determined thermal loading condition, controlling at least one of:
operating power of the x-ray tube;
operating time of the x-ray tube;
selection of a scan protocol; and,
the length of a cooling time of the x-ray tube.

19. A system for removing heat from an associated x-ray tube, the system comprising:

a fluid flow path for carrying a cooling fluid to at least a portion of the associated x-ray tube and removing heat therefrom;

a pump for circulating the cooling fluid through the fluid flow path;

a sensor for determining a pressure difference across the pump; and a controller responsive to the determined pressure difference for controlling operation of the x-ray tube.

20. The system of claim 19, further comprising a processor for determining cooling fluid flow rate from the determined pressure difference.

21. The system of claim 20, further including:

a sensor for determining a temperature of the cooling fluid, wherein the controller is responsive to the determined temperature.

22. The system of claim 21, further including:

a means for selecting a scan protocol; and a means for implementing a scan with the selected scan protocol;

wherein the controller controls at least one of:

operating power of the x-ray tube;

operating time of the x-ray tube;

selection of a scan protocol; and the length of a cooling period of the x-ray tube.

* * * * *